US006068820A

United States Patent [19]

De Guzman

[11] Patent Number: 6,068,820

[45] **Date of Patent: *May 30, 2000**

[54] FLUID/SOLUTION WIPING SYSTEM

[75] Inventor: Joselito De Guzman, Redondo Beach, Calif.

[73] Assignee: Micronova Manufacturing, Inc., Torrance, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/505,614

[22] Filed: Jul. 21, 1995

[51] Int. Cl.[7] ..... C12M 1/00

[52] U.S. Cl. ..... 422/294; 134/6; 206/229

[58] Field of Search ..... 206/229, 222, 206/223, 812, 233, 494; 401/130, 132; 134/6; 422/294; 435/287.6, 287.7, 309; 600/572

[56] References Cited

U.S. PATENT DOCUMENTS

| | | | |
|---|---|---|---|
| 3,038,473 | 6/1962 | Ladd . | |
| 3,476,506 | 11/1969 | Andersen et al. | 422/294 |
| 3,494,726 | 2/1970 | Barasch | 422/294 |
| 3,502,485 | 3/1970 | Illouze | 422/294 |
| 3,608,709 | 9/1971 | Pike | 206/47 A |
| 3,860,348 | 1/1975 | Doyle | 401/6 |
| 3,889,804 | 6/1975 | Ravich . | |
| 3,942,634 | 3/1976 | Gandi et al. | 422/294 |
| 4,140,409 | 2/1979 | De Vries | 401/132 |
| 4,347,010 | 8/1982 | Petkoff | 401/10 |
| 4,562,043 | 12/1985 | Mennen et al. | 435/287.6 |
| 4,759,472 | 7/1988 | Strenger . | |
| 4,796,751 | 1/1989 | Madkour | 206/223 |
| 4,888,229 | 12/1989 | Paley et al. . | |
| 4,893,956 | 1/1990 | Wojcik et al. | 401/130 |
| 4,946,033 | 8/1990 | Conner | 206/229 |
| 4,978,504 | 12/1990 | Nason | 435/287.6 |
| 5,041,264 | 8/1991 | Williams | 422/294 |
| 5,100,028 | 3/1992 | Seifert . | |
| 5,111,934 | 5/1992 | Morin | 206/229 |
| 5,171,523 | 12/1992 | Williams | 422/294 |
| 5,350,067 | 9/1994 | Beltran | 206/440 |
| 5,368,158 | 11/1994 | Miaud | 206/222 |
| 5,380,110 | 1/1995 | Festa . | |
| 5,439,104 | 8/1995 | Wolska-Klis | 206/233 |
| 5,464,096 | 11/1995 | Hurtwitz | 206/494 |
| 5,814,159 | 9/1998 | Paley et al. | 134/6 |

FOREIGN PATENT DOCUMENTS

WO 96/28262 9/1996 WIPO .

OTHER PUBLICATIONS

"SAFE N'FRESH", Fruit & Vegetable Rinse; distributed by American Diversified Supply Company, Knoxville, TN (date unknown).

"PROTECT ALL DOES IT ALL", Pre–treated Sponge Applicator; distributed by Protect All, Inc., Anaheim, CA (Date unknown but shows copyright notice date of 1992).

*Primary Examiner*—Jill Warden
*Assistant Examiner*—Alexander Markoff
*Attorney, Agent, or Firm*—Henricks, Slavin & Holmes LLP

[57] ABSTRACT

The proper quantity of the desired cleaning/disinfecting liquid sufficient to wet the desired wiping material is introduced into a small plastic pouch and sealed. The wiping material and the sealed pouch are placed in a plastic bag and the bag is then sealed closed. The bag is preferably sealed over the top of the plastic pouch as well, fixing the pouch in place in the bag. The sealed bag is transported to the intended cleaning location. Thereat, the bag and pouch therein are folded over onto themselves, and the folded pouch squeezed and ruptured. The liquid flows from the ruptured pouch to the wiping material soaking the same, without opening the outer bag. The outer bag is then torn open providing access to the wetted wiping material, for the desired wiping procedure.

42 Claims, 4 Drawing Sheets

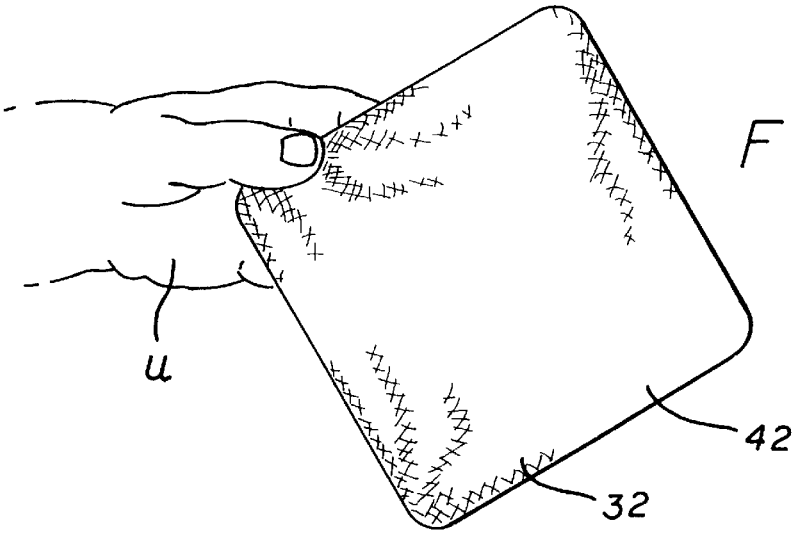
FIG. 5
FIG. 6
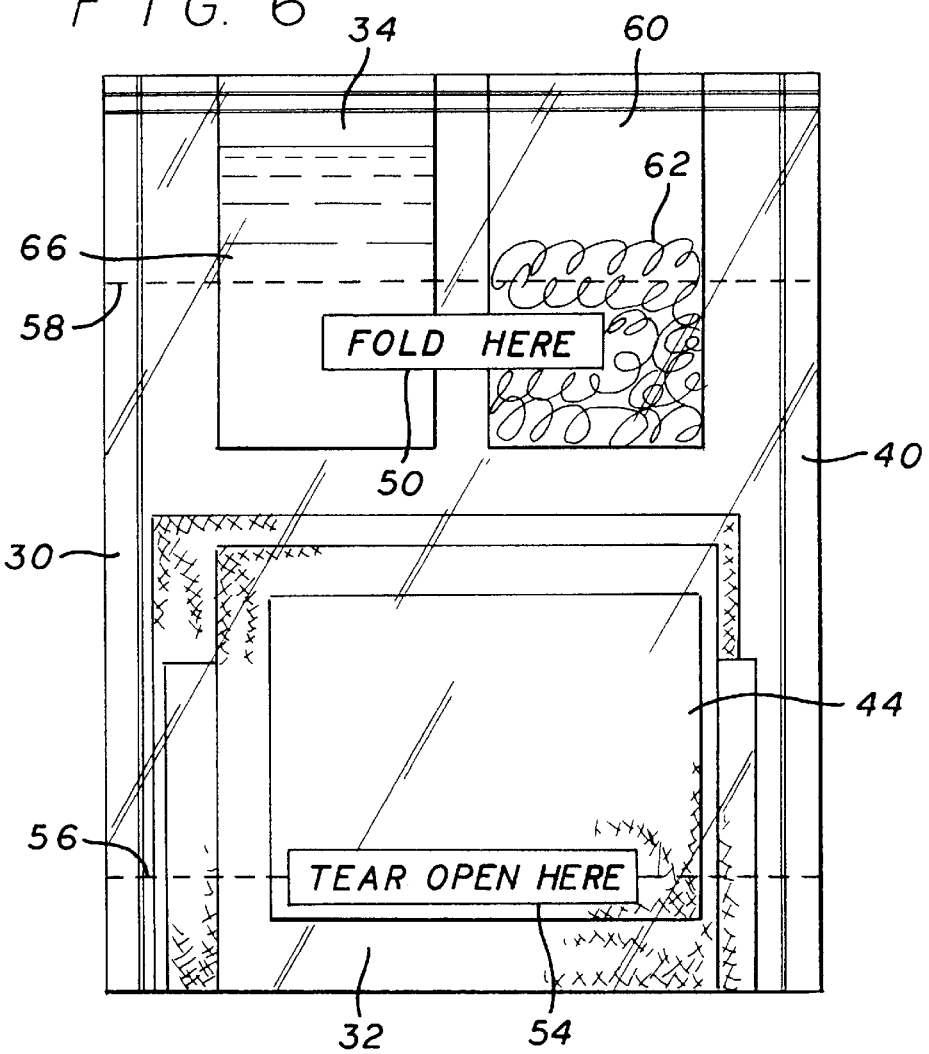

FLUID/SOLUTION WIPING SYSTEM

BACKGROUND OF THE INVENTION

1. Field of the Invention

The present invention relates primarily to systems, combinations and equipment used in and methods for cleaning/disinfecting or wiping procedures such as in "clean room" type environments.

2. Related Art

Two systems for wiping "clean room" type environments are currently used. These environments include facilities for manufacturing electronic components, medical and biotech devices, and pharmaceuticals. They further include medical and surgical facilities, such as operating rooms or trauma centers. Another example is in disc drive manufacturing such as where glue residue is to be removed from the disc drives. For this use, isopropyl alcohol or an ammonium hydroxide wiping solution on a polyurethane wipe are often used as the alcohol promotes quick drying of the cleaned surface. Other surfaces which may need to be wiped clean are table tops, walls, ceilings and floors.

One of the current wiping systems includes maintaining at the site a supply of wiping materials and a supply of cleaning/disinfecting liquids, typically in large quart or gallon containers. At the desired time the liquid is poured from the large containers onto the wiping material or sometimes first into smaller squirt bottles or dispensers and then deposited on the wiping material. Different liquids may first need to be mixed if required to get the desired cleaning/disinfecting solution. This pouring and mixing is labor intensive, can result in error in the solution produced and can result in wastage if liquid is spilled or excess liquid is poured on the wiping material. If the liquid is caustic or strong and is spilled, damage or injury may result. Also a large inventory of liquids and wiping materials needs to be maintained as needs and wiping requirements change.

Pursuant to the second known wiping system, the wiping material is pre-moistened or soaked in the cleaning/disinfecting liquid, packaged in a plastic bag and shipped to the intended user. There are a number of disadvantages and problems with this system. If stronger or more caustic cleaning/disinfecting liquids are used (as is the trend today), the liquid will eat away and actually disintegrate the wiping material if it remains in the bag more than a few days, one week or a couple of weeks, the time from assembly thereof to use (including shipping and shelf time). Thus, only a very short shelf life is available and the liquids which can be used are limited. Also, if the soaked wiping material remains in the bag too long, the liquid may act upon and discolor the bag. While this may not adversely affect the wiping material, the liquid or the bag, the discoloration gives the appearance that the soaked wipe is no longer usable, and the intended user may thus unnecessarily discard it.

SUMMARY OF THE INVENTION

Directed to remedying the problems and disadvantages of the prior art, an improved cleaning/disinfecting wiping system is herein disclosed. The system can be provided in a convenient kit form, assembled as described below. The proper amount of fluid, such as a cleaning/disinfecting liquid, is introduced and sealed in a container such as a plastic pouch or bag, the air is preferably evacuated therefrom and the pouch is sealed closed. The sealed pouch and a wiping material are inserted into an outer container such as a plastic bag. Preferably with the top of the pouch adjacent or aligned with the top of the plastic bag, the bag may be sealed closed on the pouch top if desired but such sealing is not necessary. The pouch would be thereby held in place in the bag.

In one preferred form of the invention, the bag, wipe material and fluid containing pouch are assembled at a warehouse, or other assembly or supply location after an order is placed for a system having the desired material and fluid. In other words, an extensive supply of different types and amounts of pouch-contained liquids and wiping materials are separately maintained at that supply location. When the order from the customer is received, the desired pouched-contained liquid and wiping material are conveniently collected from the ready supply and sealed in a bag and shipped to the customer.

In a preferred embodiment, the material is a wipe material and the fluid is a cleaning or disinfecting liquid. The sealed bag holding the wiping material and the sealed pouch filled with the cleaning/disinfecting liquid is transported to the intended location. Thereat the pouch, and preferably both the bag and pouch, are folded over on themselves and the pouch squeezed between the user's fingers (and preferably through the outer bag). The pouch is thereby ruptured, releasing its liquid onto the wiping material, wetting or moistening it. Since the plastic material of the outer bag is thicker or stronger than that of the inner pouch, or, where they are the same strength but because sufficient pressure is not developed in the outer bag to rupture it, the outer bag is not ruptured by the squeezing action. The wiping material can be removed either before or after it is moistened and used as desired. Preferably, however, the outer bag is sealed until the wiping material is moistened. Thereafter, the outer bag is torn open by the user providing ready access to the moistened wiping material for the desired wiping operation.

Folding, squeezing and tearing locations and instructions can be conveniently printed on the outer bag. Since the liquid is not applied to the wiping material until shortly before use, stronger cleaning or disinfecting liquids can be used than in the past.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 5 shows the moistened wiping material removed from the package of the assembly of FIG. 4, ready for use;

FIG. 6 is a view similar to FIG. 1 showing a first alternative assembly of this invention using different wiping material, such as towels instead of a pad, and showing the use of two inner pouches instead of one;

DETAILED DESCRIPTION OF THE PREFERRED EMBODIMENTS

Figure 2:
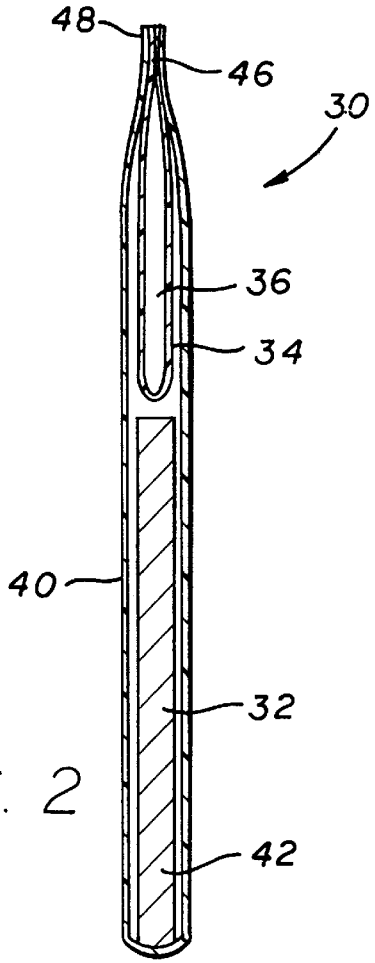
FIG. 2 is a cross-sectional view taken on line 2—2 of FIG. 1.
Figure 1:
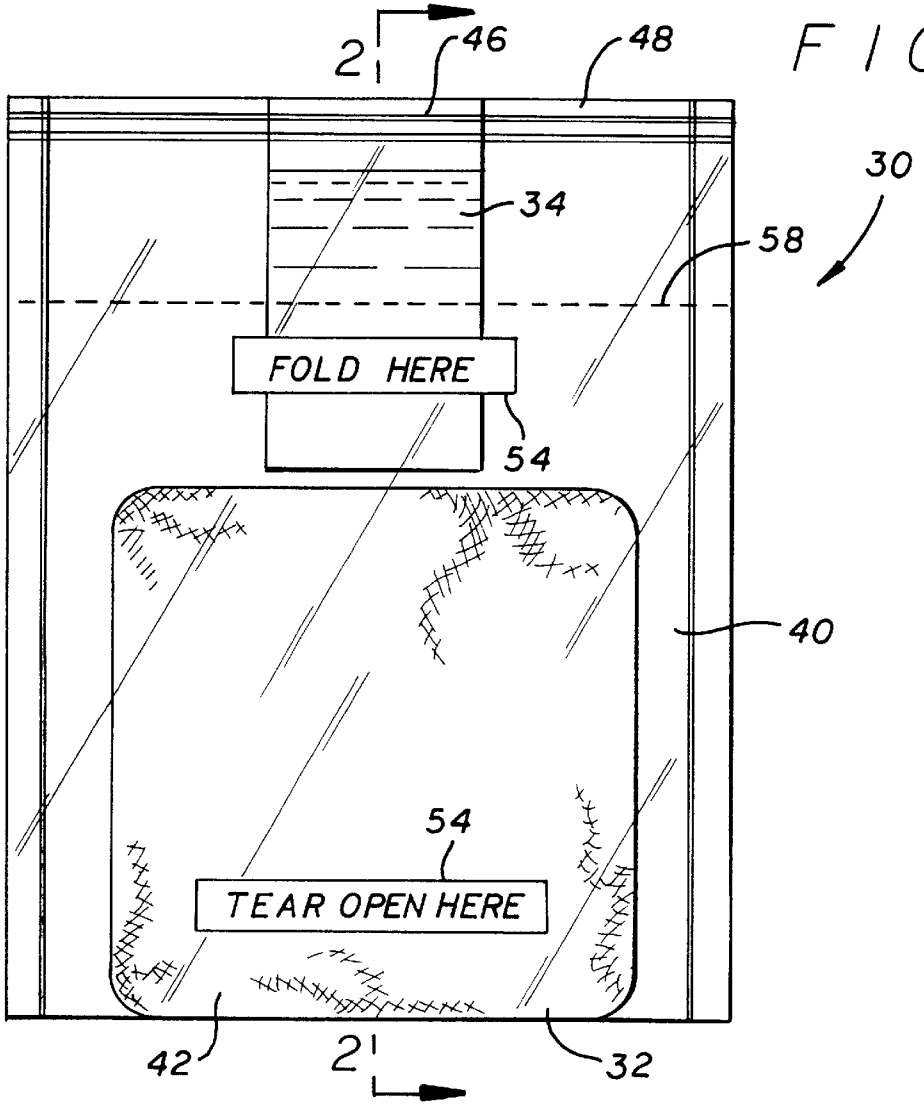
FIG. 1 is a front plan view of a cleaning/disinfecting wipe assembly according to one preferred aspect of the present invention.

A cleaning/disinfecting wipe system or assembly of the present invention is shown, for example, in FIGS. 1 and 2 generally at 30. The assembly 30 is preferably constructed as a package or kit. It includes wiping material 32 and a small sealed pouch or inner bag 34 containing a cleaning/disinfecting fluid or liquid hereinafter referred to as liquid 36. Both the wiping material 32 and pouch 34 are contained and preferably enclosed within an outer bag 40.

A variety of materials can be used for the wiping material 32 as are known in the prior art. Examples thereof are foam pads, paper based cellulose, polyesters, and fabrics such as rayon, nylon blend and cotton blend. They can be in the form of a pad such as shown in FIGS. 1 and 2 at 42 or in the form of a number of towels or folded over sheets of material such as shown in FIG. 6 at 44. For example, the wiping material 32 can be approximately 3½×3½ inches in plan view and when wetted expands approximately 20% to 50% or about 25% to approximately 4½× 4½ inches, such as for a polyurethane wipe using an alcohol solution with sterilant. Part of the swelling is due to the absorption of the water in the liquid 36 and part is due to a chemical reaction of the wipe with the sterilant or alcohol in the liquid. For today's Hightensile or Supersoft polyurethane foams the expansion or swell can be 30% to 150%. These foams are desirable wiping materials 32 because they do not tear easily when wet.

The liquid 36 can be any number of solutions or solvents which can be used for cleaning and/or disinfecting or simply applying a liquid. Instead of a normal free flowing liquid it can be a foam, for example (or a powder). The amount of liquid 36 provided in the pouch 34 will vary depending upon the liquid itself, and the size and absorbency of the wiping material 32. The amount should be enough to wet all of the wiping material 32 but not so much that it is soaking or dripping or such that the liquid will ooze out during the wiping procedure. It typically would be about ten to twenty milliliters, for an average wipe.

An example of a common cleaning liquid 36 which can be used is a mixture of de-ionized water and isopropyl alcohol in different concentrations. The concentrations might be 70/30 (water to alcohol), 80/20 or 50/50. Another example is a more aggressive solution, such as 5% isopropyl alcohol, 1% to 5% ammonium hydroxide and the remainder de-ionized water. If this aggressive solution is used in the prior art pre-packaged pre-moistened system, the ammonium hydroxide over a period of time attacks the (polyurethane) wiping material, causing it to swell and disintegrate. The same is true for two other common disinfecting agents, namely quanterey and phenolic based disinfectants. Quanterey has a caustic solution in it, and phenolic based disinfectants have a petroleum-based benzene agent. Although benzene has been used with some very absorbent wiping materials and provides an excellent wiping action, it can attack a polyurethane wipe in a matter of hours, causing it to swell and disintegrate. However, if these stronger or caustic solutions or liquids 36 are used to wet polyurethane foam 32 and the wetted foam is used for cleaning for minutes or a couple of hours as would typically be done with the present system and then discarded, there is in practice no deterioration of the foam. This is because the liquid 36 does not have sufficient time to attack the wipe material 32.

A number of suitable materials are available for the two bags 34, 40 including standard polyethylene or polypropylene. Where the liquid 36 to be contained in the inner bag 34 is a harsh chemical then other types of bag materials may need to be used. An example is to line the pouch 34 with foil, similar to the construction of small ketchup packets. Alternatively, the bag or pouch 34 can be made from Teflon.

Figure 4:
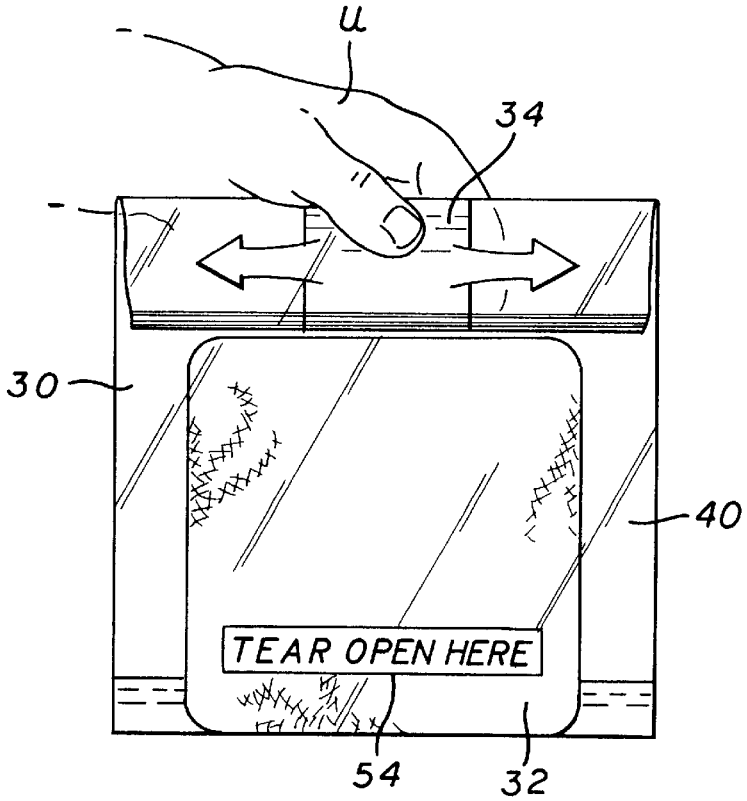
FIG. 4 shows a squeeze-rupturing procedure on the folded assembly of FIG. 3.
Figure 8:
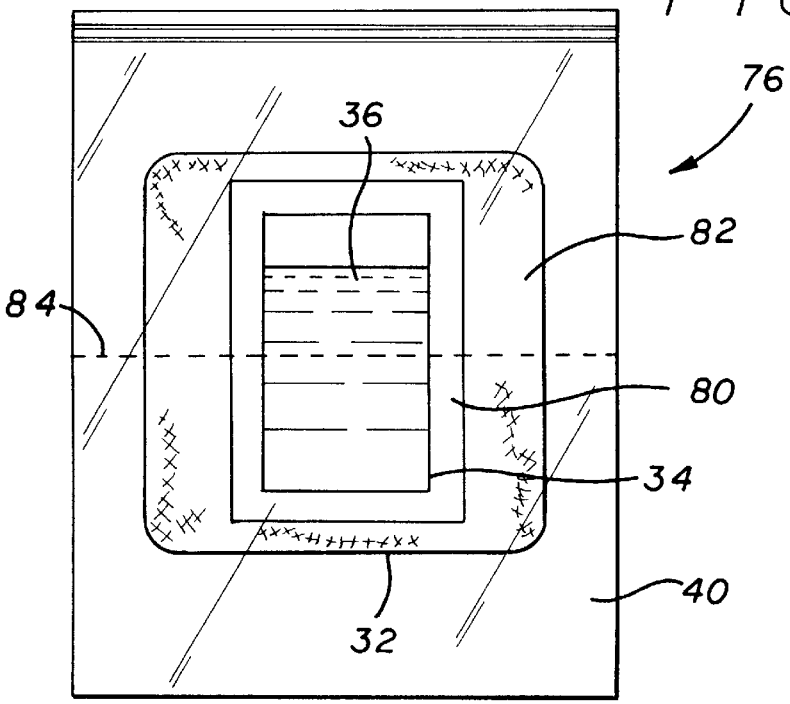
FIG. 8 is a rear view of a third alternative assembly.

Both the inner and outer bags 34, 40 can have thicknesses from one millimeter up to three or four millimeters or more, depending on the application and use. The inner pouch 34 would likely be thinner than the outer bag 40 or they could be the same thickness. Having the inner bag 34 being thinner facilitates easier rupturing thereof without rupturing the outer bag 40, as will be described later and as shown in FIG. 4. The inner bag or pouch 34 can be about one by two inches in plan view. The outer bag 40 can be six inches square for example. Both the inner and outer bags 34, 40 can have any suitable shape such as round, square or triangular. Their shapes can be the same or different if desired. For example, it may be beneficial for the outer bag 40 to have the same shape as the wiping material 32. FIG. 8 shows them both being square or rectangular, but they alternatively can both be round.

After the liquid 36 has been placed in the inner pouch 34, the air evacuated from the pouch and the pouch sealed, the sealed pouch is put in the outer bag 40. Then with the wiping material 32 in the outer bag 40 and the sealed pouch 34 therein with the top 46 thereof aligned with the top of the open bag, the top edges 48 of the outer bag are heat sealed shut over the top of the inner bag thereby holding the inner bag in place relative to the interior of the outer bag. This is shown in FIG. 2. By attaching the inner bag 34 in place to the outer bag 40 at a central location at the top thereof, the inner bag extends down into the outer bag, to assist in folding as discussed below. Folding, squeezing and tearing locations and instructions 50, 52, 54, respectively, can be fixed to or printed on the outer bag 40. Instructions and operation points can also be placed on the pouch 34. The indicated tearing location 54 is preferably at a bottom area of the outer bag 40, where it is out of the way of the inner pouch or bag 34 as well as the folding and squeezing instructions 50, 52. Dotted line indicia as shown in FIG. 6 at 56 showing where the outer bag 40 can be pulled or torn open can be used. It is also within the scope of the invention to provide a small precut or weakened area on the outer bag 40 at the tear location to assist in the tearing procedure.

Figure 3:
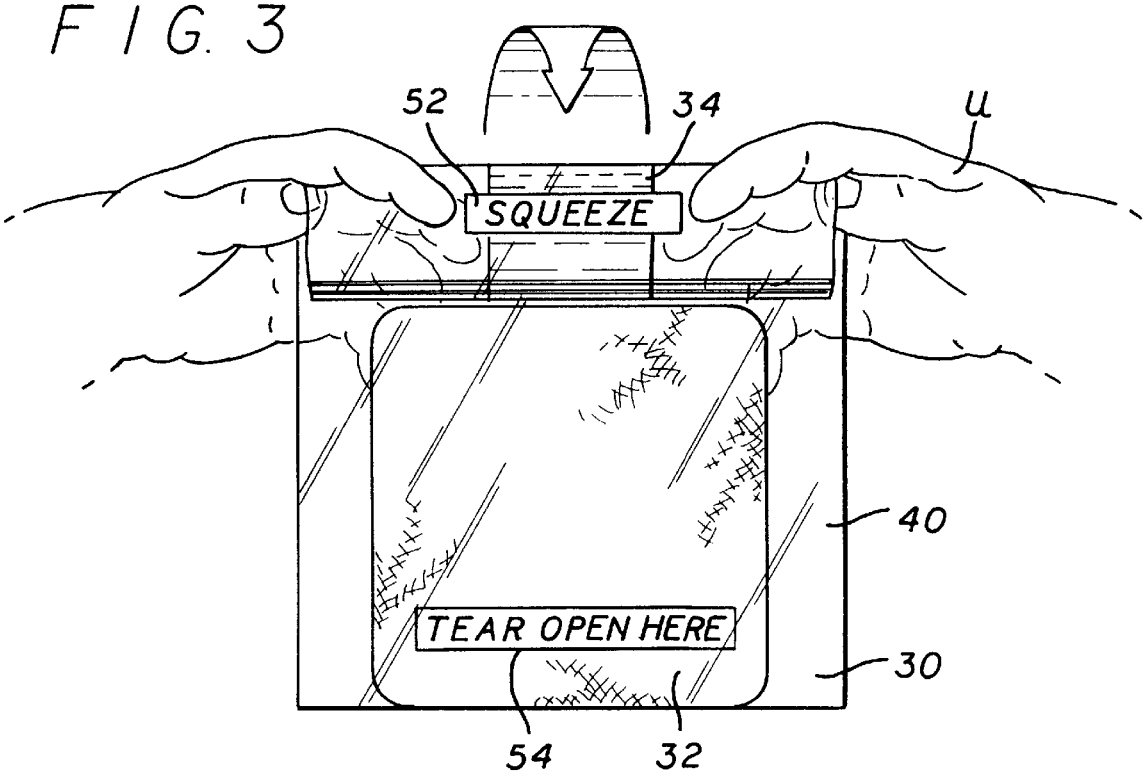
FIG. 3 is a view of the assembly of FIG. 1 showing a folding procedure thereon.

The entire assembly or kit 30 is then delivered to the user who takes it to the desired cleaning location. At the desired time the user U will fold the top approximately one-third of the outer bag 40 onto itself on the fold line 58 and thereby fold the inner bag 34 approximately in half. This is best shown in FIG. 3. The user U then holds the folded inner bag 34 between the fingers and squeezes it generally at squeeze location 52, thereby rupturing the inner bag 34, usually at the bottom thereof. By folding the inner bag 34, the squeeze-pressure per unit area exerted is thereby increased and thus the likelihood of rupture. The assembly 30 is preferably designed so that the inner bag 34 without being folded cannot be ruptured by simple squeezing thereby minimizing accidental rupture. The squeeze-rupture step is shown in FIG. 4.

With the inner bag 34 ruptured, the liquid 36 therein is released and soaks the wiping material 32. Since the outer bag 40 is still intact in the preferred embodiment, no liquid 36 leaks out and the wiping material 32 becomes soaked with the liquid. The containment in bag 40 is especially advantageous where the liquid on the wiping material may at least initially emit a disagreeable odor. However, care should still be exercised in the event of an accident and the assembly 30 kept away from eyes and faces during squeezing thereof. Then at the desired time the outer bag 40 is torn-open, or otherwise opened, such as by following the tearing instructions 54 and the wetted wiping material 32 is removed out through the torn opening. With the wetted wiping material 32 removed as shown in FIG. 5, the desired surfaces can be effectively cleaned. Examples of surfaces, sites and environments which can be cleaned have been discussed previously.

Since the liquid 36 contacts the wiping material 32 for only a relatively short time (the actual time after the inner bag 34 has ruptured and until the wiping procedure is completed, perhaps only minutes or hours), there is negligible if any disintegration of the wiping material by even strong or aggressive liquids. Thus stronger, caustic or more reactive liquids can be used for assembly 30 than the prior art premoistened system where the liquid would be on the wipe for a week, for example, before use. For example, liquid 36 can be a cleaning/disinfecting liquid which is so reactive as to start to disintegrate the wiping material 32 in an hour or two, that is, simply the time of the wiping procedure. Aggressive liquids as used herein would include liquids which may adversely affect the wipe or the container of conventional wipe assemblies if combined and shipped under conventional procedures.

Another advantage of assembly 30 over the prior art prepackaged pre-moistened system is that pursuant to the present invention the liquid 36 is in contact with the outer bag 40 only briefly (after the inner pouch 34 has been ruptured and before the wetted wiping material 32 is removed therefrom). Thus, if the liquid 36 is strong or caustic and an expensive pouch or bag material is needed to safely and reliably contain it, the material is needed only for the small inner pouch 34 and not necessarily for the larger outer bag 40. In contrast, the prior art system requires that the expensive material be used for the large outer bag.

A further advantage of the present invention is that the overall size of the assembly 30 often can be smaller than the prior art pre-moistened packages. This is because many types of prior art wiping materials when moistened expand 20% to 50% thereby increasing the size of the prior art package to be transported and stored. In other words, approximately 25% less volume is needed for storing and shipping the present assembly 30 than the prior art pre-moistened packages.

A still further advantage is that since the wiping material 32 is (typically) packaged dry in the outer bag 40, mold, cultures, bacteria or other contaminants cannot grow on it. This can be a problem under certain circumstances with the prior art packaged pre-moistened wipes.

For the prior art pre-moistened and packaged wipes where stronger liquids than alcohol solutions or new and different solutions are being used and the long term effects on the wiping material are not known, lengthy and/or expensive studies may need to be conducted to determine whether the wiping material will react or disintegrate over time while in its package. However, for the present invention where the liquid 36 remains on the wiping material 32 before disposal thereof for only minutes or hours, these studies are not necessary or at least less involved.

A still further use of the present invention is where two chemicals are to be mixed on or in proximity to the wiping material 32 and when mixed react somewhat violently or in such a way that one week advance mixing is not desirable. Thus the present invention allows this reaction, if mild, to be safely contained in the sealed outer bag 40. It is also within the scope of the present invention to provide a second sealed pouch such as shown in FIG. 6 at 60, which can contain a second chemical, liquid or substance 62. The second pouch 60 would be rupturable within the outer bag 40 similar to the first pouch 34.

The pouches 34 and 60 are shown in FIG. 6 as completely separated bags. This allows flexibility in mixing and matching from the inventory to meet a client's specific cleaning/disinfecting needs. Alternatively the pouches 34 and 60 can be different compartments in a single somewhat larger bag. That is, the two pouches could be side-by-side sharing a common seal line, or be two bags joined together. This arrangement can make it easier to rupture both bags in a single step. It also can assist in a more thorough mixing of the two contents. Another embodiment packages the two liquids or substances in separate compartments which can be ruptured so that they mix in a sealed mixing compartment and then the mixing compartment can be broken to release the mixed liquids onto a wiping material in an outer bag.

The front and back sheets of the outer bag 40 can both be clear or transparent. This allows the bag contents to be easily seen to confirm that they are correct or to provide easy identification thereof. Indicia 66 can be printed on the small pouch 34 describing the contents of the liquid 36 therein. This allows the contents to be checked after packaging and also identifies the contents before packaging in the warehouse. Alternatively, one of the front and back can be opaque and have instructions, information on physical properties of chemicals, warnings, advertisements or the like printed on it. One embodiment of the outer bag 40 thereof has the opaque side formed of TYVEK and the other side formed of a different material such as clear/transparent plastic and the two sheets are joined around their perimeters. At the bottom the sheets can be slightly separated, allowing them to be peeled apart to open the outer bag.

Figure 7:
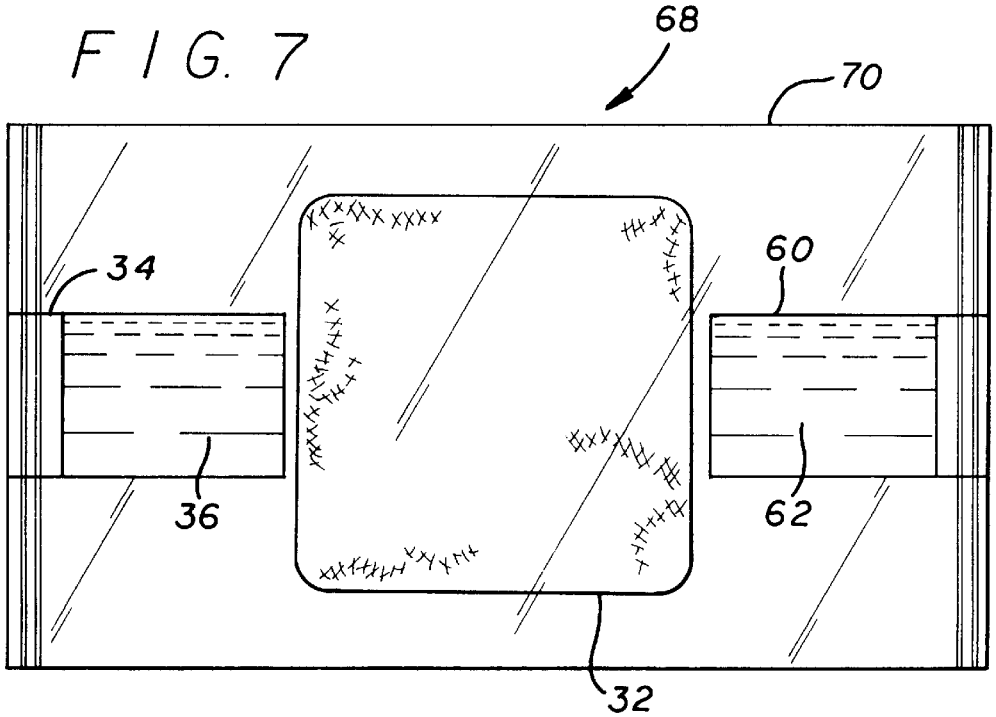
FIG. 7 is a front view of a second alternative assembly.

The wiping assembly of FIG. 6 shows the two pouches 34, 60 sealed to the same (top) edge of the outer bag 40. Alternatively and referring to assembly 68 of FIG. 7 the pouches 34, 60 can be sealed to opposite ends of the outer bag 70. Bag 70 can have an elongate shape with the central portion providing a tight fit around the wiping material 32. Assembly 68 can be used when the liquids 36 and 62, if mixed quickly and completely would react aggressively. The arrangement of assembly 68 allows the two liquids to mix slowly. Each is absorbed slowly at opposite ends of the wiping material 32 which then acts to slow down and control the mixing.

A still further embodiment of the invention is shown in FIG. 8 by assembly 76. Assembly 70 includes an outer bag 40, with the wiping material 32 substantially filling the outer bag. That is, the wiping material 32 has only slightly smaller length and width dimensions than the interior of the bag. The small pouch 34 is sealed about its perimeter 80 to an interior face of the front or back sheet 82 of the bag 40. Thereby the pouch 34 is substantially centered on the wiping material 32.

A fold line 84 on the outer bag 40 extends across generally the middle thereof and the middle of the pouch 34. Then when the assembly 76 is folded on the fold line 84 and squeezed on the pouch 34, the pouch ruptures releasing its liquid 37 directly on the center of the wiping material 32. This promotes rapid absorption or wetting of the entire wiping material 32. Where the liquid 37 is an aggressive solution, the arrangement of assembly 76 provides extra protection against the spilling or release of the liquid should the outer bag 40 accidently break. This is because all or nearly all of the liquid 37 will be absorbed by the wiping material 32 and not free flowing.

In summary, the existing pre-moistened wipes out in the market have certain limitations not present with the present assembly 30, namely:

(a) Shelf life. The prior art packaging has a tendency to discolor in some solutions due to the chemical reacting to the packaging. The chemical or cleaning solution can also leak out and dry out the wipes. The chemical would also attack or react with the wipes on long exposures.

(b) Packaging. Thick, inert and expensive packaging is necessary to prevent some chemicals from reacting and leaking out of the packaging.

(c) Wipe and chemical limitations. Only inert wipes and mild chemical solutions could be used since the wipes may react with the solution over long periods of time.

(d) Freshness. The wipes that are newly manufactured are better than wipes that have been sitting on the shelf over long periods of time.

(e) Inventory control. The manufacturer has to store specific pre-moistened wipes. Once the wipes are moistened with a certain solution, they cannot be used for other solutions.

(f) Cost. Due to the special packaging material and handling required for the pre-moistened wipes, the cost is high.

Thus, there are many advantages as discussed below of the present assembly 30 over the prior art.

(1) Shelf life. Shelf life is greatly extended without using a significant amount of special and/or expensive packaging.

(2) Inventory reduction. Wiping materials can be stored dry and can be easily combined with packets of desired chemicals when needed.

(3) Convenience for the user. The wipes are ready to use.

(4) Safety. No need to mix or handle chemicals. Only a small amount of chemical is exposed versus using spray bottles or pump canisters.

(5) Cleanliness. Chemicals and wipes are not as susceptible to contamination due to handling and mixing.

(6) Wipe material and chemical combinations are greatly expanded. The wipe material will not react with the chemicals during storage. Materials such as polyurethane foam can be packaged with strong sterilants.

(7) Freshness. The wipes and chemicals are fresh and ready to be used when needed.

(8) Shipping. The chemical packets can withstand shipping without leaking, yet be convenient to release by folding and squeezing when needed. The wipes are also less bulky because they are dry.

(9) Less costly. Custom wipes and chemical combinations can be easily made without the need for dedicated and expensive manufacturing process.

With the foregoing detailed description, there are a number of changes, adaptations and modifications of the present invention which still come within the scope of the invention. However, it is intended that all such variations not departing from the spirit of the invention be considered as within the scope thereof as limited solely by the claims appended hereto.

What is claimed is:

1. A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein, and configured such that the sealed pouch is not rupturable by manual squeezing in an unfolded configuration and such that the sealed pouch is rupturable by squeezing in a folded configuration; and a sealed container having a container wall and containing therein said clean wiping material and said pouch such that said pouch can be selectively ruptured by folding the pouch and applying a force to the container wall without breaching the container wall so that a force is applied to the pouch to rupture the pouch to thereby release said fluid into the container to contact and wet the wiping material, such that the wetted wiping material is removable from the container separate from the pouch, and wherein the sealed container is impermeable to the fluid.

2. The system of claim 1 wherein said fluid is a cleaning liquid.

3. The system of claim 1 wherein said fluid includes a disinfecting liquid.

4. The system of claim 1 wherein said fluid is a mixture of de-ionized water and isopropyl alcohol.

5. The system of claim 1 wherein said fluid includes ammonium hydroxide.

6. The system of claim 1 wherein said fluid includes a phenolic base disinfectant.

7. A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein, and configured such that the sealed pouch is not rupturable by manual squeezing in an unfolded configuration and such that the sealed pouch is rupturable by squeezing in a folded configuration; and a sealed container having a container wall and containing therein said clean wiping material and said pouch such that said pouch can be selectively ruptured by folding the pouch and applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid, and wherein said sealed container includes fold line indicia denoting a line about which said sealed container and said sealed pouch therein can be folded for subsequent pressure rupturing of said sealed pouch and release of said fluid onto said wiping material.

8. The system of claim 1 wherein said sealed container includes fold line indicia denoting a line about which said sealed container and said sealed pouch therein can be folded for subsequent pressure rupturing of said sealed pouch and release of said fluid onto said wiping material.

9. The system of claim 1 wherein at least a portion of said sealed pouch is secured to a surface of said sealed container.

10. The system of claim 1 wherein said sealed container includes indicia indicating a tear-open location for tearing opening said sealed container to access said wetted wiping material therewithin.

11. The system of claim 1 wherein said sealed container includes indicia indicating a squeeze location for squeezing said sealed container and thereby said sealed pouch therewithin and to thereby rupture said sealed pouch.

12. The system of claim 1 wherein said wiping material comprises fabric material.

13. The system of claim 1 wherein said wiping material comprises a polyurethane pad.

14. A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein, and configured such that the sealed pouch is not rupturable by manual squeezing in an unfolded configuration and such that the sealed pouch is rupturable by squeezing in a folded configuration; and a sealed container having a container wall and containing therein said clean wiping material and said pouch such that said pouch can be selectively ruptured by folding the pouch and applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid, and wherein said sealed pouch and said sealed container are formed of the same material, the material of said sealed pouch being thinner and thus more easily pressure rupturable than that of said sealed container.

15. The system of claim 1 wherein said sealed pouch and said sealed container are formed of the same material, the material of said sealed pouch being thinner and thus more easily pressure rupturable than that of said sealed container.

16. The system of claim 1 wherein said sealed container comprises a flexible plastic bag.

17. The system of claim 1 wherein said fluid is a saline solution and said wiping material is gauze.

18. The system of claim 1 further comprising said sealed pouch defining a first sealed pouch, and a second sealed pouch containing a substance, said second sealed pouch being disposed in and rupturable while within said container, such that said substance and said fluid can act in concert.

19. The system of claim 1 wherein said sealed pouch is attached to an inner face of said sealed container.

20. The system of claim 19 wherein said sealed pouch is sealed about its perimeter to said inner face.

21. The system of claim 19 wherein said sealed pouch is adjacent a width and length portion of said wiping material.

22. The system of claim 1 further comprising said sealed pouch defining a first sealed pouch and said fluid defining a first fluid, and a second sealed pouch containing a second fluid and disposed in said sealed container and rupturable therein.

23. A wiping system for cleaning, the system including:

a sealed rupturable container containing a fluid selected from the group consisting of a cleaning fluid and disinfecting fluid wherein the rupturable container includes a container wall impermeable to the fluid and sealed with a uniform seal, and configured such that the sealed pouch is not rupturable by manual squeezing in an unfolded configuration and such that the sealed pouch is rupturable by squeezing in a folded configuration;

a second container having a second container wall impermeable to the fluid and containing the rupturable container, the rupturable container being rupturable by folding the sealed rupturable container and applying a force to the second container wall without breaching the container wall so that a force is applied to the rupturable container to rupture the rupturable container such that the fluid from a ruptured container can enter the second container; and a wiping element removably contained inside the second container containing the rupturable container such that the fluid can come into contact with the wiping element when the rupturable container is ruptured.

24. A wiping system for cleaning, the system including:

a sealed rupturable container containing a fluid selected from the group consisting of a cleaning fluid and disinfecting fluid wherein the rupturable container includes a container wall impermeable to the fluid and sealed with a uniform seal;

a second container having a second container wall impermeable to the fluid and containing the rupturable container, the rupturable container being rupturable by applying a blunt force to the second container wall without breaching the container wall so that a blunt force is applied to the pouch to rupture the pouch such that the fluid from a ruptured container can enter the second container; and a wiping element removably contained inside the second container containing the rupturable container such that the fluid can come into contact with the wiping element when the rupturable container is ruptured.

25. The wiping system of claim 24 wherein the sealed rupturable container includes fold line indicia to indicate a line about which the sealed rupturable container can be folded for bursting the sealed rupturable container and releasing the fluid into the second container.

26. The system of claim 25 wherein the sealed rupturable container includes a length and a width, and wherein the length is greater than the width.

27. The wiping system of claim 26 wherein at least part of the sealed rupturable container is fixed to a portion of the second container wall.

28. The system of claim 26 wherein at least part of the sealed rupturable container is fixed to the second container wall.

29. The wiping system of claim 28 wherein the second container wall includes at least three sides wherein the at least three sides are sealed to form respective edges, and wherein at least part of the sealed rupturable container is fixed to one of the edges of the second container.

30. The system of claim 26 wherein a side defining the width is attached to an edge of the second container and wherein the sealed rupturable container includes fold line indicia for indicating approximately where the sealed rupturable container can be folded, and wherein the fold line indicia extend at least partly parallel to the width of the sealed rupturable container.

31. The system of claim 26 wherein the rupturable container wall has a thickness and the second container wall has a thickness greater than the thickness of the sealed rupturable container wall.

32. The wiping system of claim 31 wherein the rupturable container wall and the second container wall are formed from polyethylene.

33. The wiping system of claim 26 wherein the second container wall includes weakness portions formed in the second container wall for permitting opening of the second container.

34. The wiping system of 26 wherein the sealed rupturable container is rupturable through the second container wall while the second container wall remains sealed and impermeable to the fluid.

35. A wiping system for cleaning, the system including:

a sealed rupturable container containing a fluid selected from the group consisting of a cleaning fluid and disinfecting fluid wherein the rupturable container includes a container wall impermeable to the fluid and sealed with a uniform seal, and configured such that the sealed pouch is not rupturable by manual squeezing in an unfolded configuration and such that the sealed pouch is rupturable by manual squeezing in a folded configuration;

a second sealed container having a second container wall impermeable to the fluid and containing the rupturable container, the rupturable container being rupturable by folding the sealed rupturable container and applying a blunt force to the second container wall without breaching the container wall so that a blunt force is applied to the rupturable container to rupture the rupturable container such that the fluid from a ruptured container can enter the second container; and a wiping element removably contained inside the second container containing the rupturable container such that the fluid can come into contact with the wiping element when the rupturable container is ruptured.

36. The system of claim 35 wherein the sealed rupturable container is a single chambered container.

37. The system of claim 35 wherein the container walls are made from a flexible material.

38. The system of claim 37 wherein the container walls are made from the same material.

39. The system of claim 35 wherein the sealed rupturable container wall has a thickness and the second container wall has a thickness greater than the thickness of the sealed rupturable container wall.

40. The system of claim 35 wherein the rupturable sealed container is attached to the second sealed container.

41. The system of claim 40 wherein the rupturable sealed container is attached to the second sealed container along an edge of the second sealed container.

42. The system of claim 35 wherein the sealed rupturable container is formed from polyethylene and includes a width and a length wherein the length is greater than the width, and a fold line indicator extending at least partly parallel to the width and wherein the rupturable sealed container and the second sealed container each include edges, wherein one edge of the rupturable sealed container is attached to the second sealed container along an edge of the second sealed container, and wherein the second sealed container wall is formed from polyethylene having a thickness, wherein the sealed rupturable container wall has a thickness less than the thickness of the second container wall thickness.

* * * * *

UNITED STATES PATENT AND TRADEMARK OFFICE

CERTIFICATE OF CORRECTION

PATENT NO. : 6,068,820
DATED : May 30, 2000
INVENTOR(S) : Joselito De Guzman

It is certified that error appears in the above-identified patent and that said Letters Patent is hereby corrected as shown below:

Column 8,
Lines 22-48, change claim to read as follows:

A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein; and a sealed container having at least two container walls and containing therein said clean wiping material and said pouch such that said pouch can be selectively ruptured by applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid, wherein the sealed container is sealed across a portion of the sealed pouch positioned between the at least two container walls.

Lines 49-53, change claim to read as follows:

A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein, and configured such that the sealed pouch is not rupturable by manual squeezing in an unfolded configuration and such that the sealed pouch is rupturable by squeezing in a folded configuration; and a sealed container having a container wall and containing therein said clean wiping material and said pouch such that said pouch can be selectively ruptured by folding the pouch and applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid, and wherein said sealed container includes fold line indicia denoting a line about which said sealed container and said sealed pouch therein can be folded for subsequent pressure rupturing of said sealed pouch and release of said fluid onto said wiping material.

UNITED STATES PATENT AND TRADEMARK OFFICE

CERTIFICATE OF CORRECTION

PATENT NO. : 6,068,820
DATED : May 30, 2000
INVENTOR(S) : Joselito De Guzman

It is certified that error appears in the above-identified patent and that said Letters Patent is hereby corrected as shown below:

Column 9,
Lines 1-26, change claim to read as follows:
The system of claim 1 wherein said wiping material comprises a foam pad.

Lines 27-30, change claim to read as follows:

A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein, and configured such that the sealed pouch is not rupturable by manual squeezing in an unfolded configuration and such that the sealed pouch is rupturable by squeezing in a folded configuration; and a sealed container having a container wall and containing therein said clean wiping material and said pouch such that said pouch can be selectively ruptured by folding the pouch and applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid, and wherein said sealed pouch and said sealed container are formed of the same material, the material of said sealed pouch being thinner and thus more easily pressure rupturable than that of said sealed container.

---

Column 9, line 52 to Column 10, line 7,
Change the claim to read as follows:

A cleaning wiping system, comprising:

clean wiping material suitable for use in cleaning a surface;

a sealed pouch containing a quantity of a fluid selected from the group consisting of a cleaning fluid and disinfecting fluid wherein the pouch is impermeable to the fluid contained therein;

a sealed container having a container wall and containing therein said clean wiping material and said pouch such that said pouch can be selectively ruptured by applying a blunt force to the container wall without breaching the container wall so that a blunt force is applied to the pouch to rupture the pouch to thereby release said fluid into the container to contact and wet the wiping material, such that the wetted wiping material is removable from the container separate from the pouch, and wherein the sealed container is impermeable to the fluid; and said sealed pouch defining a first sealed pouch and said fluid defining a first fluid, and a second sealed pouch containing a second fluid and disposed in said sealed container and rupturable therein, wherein said first and second pouches are secured at opposite ends of said sealed container and said wiping material is disposed therebetween and with a close fit to prevent either of said first and second fluids from flowing to the opposite ends.

---

UNITED STATES PATENT AND TRADEMARK OFFICE

CERTIFICATE OF CORRECTION

PATENT NO. : 6,068,820
DATED : May 30, 2000
INVENTOR(S) : Joselito De Guzman

It is certified that error appears in the above-identified patent and that said Letters Patent is hereby corrected as shown below:

Column 10,
Lines 8-25, change the claim to read as follows:

A wiping system for cleaning, the system including:

a sealed rupturable container containing a fluid selected from the group consisting of a cleaning fluid and disinfecting fluid wherein the rupturable container includes a container wall impermeable to the fluid and sealed with a uniform seal, and configured such that the sealed pouch is not rupturable by manual squeezing in an unfolded configuration and such that the sealed pouch is rupturable by squeezing in a folded configuration;

a second container having a second container wall impermeable to the fluid and containing the rupturable container, the rupturable container being rupturable by folding the sealed rupturable container and applying a force to the second container wall without breaching the container wall so that a force is applied to the rupturable container to rupture the rupturable container such that the fluid from a ruptured container can enter the second container; and a wiping element removably contained inside the second container containing the rupturable container such that the fluid can come into contact with the wiping element when the rupturable container is ruptured.

Signed and Sealed this

Tenth Day of August, 2004

JON W. DUDAS
*Acting Director of the United States Patent and Trademark Office*